US010619871B2

(12) United States Patent
Glenn et al.

(10) Patent No.: US 10,619,871 B2
(45) Date of Patent: Apr. 14, 2020

(54) ROOF VENTILATOR REINFORCEMENT AND HINGE SYSTEM

(71) Applicant: Driploc, Inc., Oklahoma City, OK (US)

(72) Inventors: Benjamin Glenn, Oklahoma City, OK (US); Barry Wagner, Oklahoma City, OK (US)

( * ) Notice: Subject to any disclaimer, the term of this patent is extended or adjusted under 35 U.S.C. 154(b) by 188 days.

(21) Appl. No.: 15/481,246

(22) Filed: Apr. 6, 2017

(65) Prior Publication Data

US 2017/0370601 A1 Dec. 28, 2017

Related U.S. Application Data

(60) Provisional application No. 62/319,516, filed on Apr. 7, 2016.

(51) Int. Cl.
*F24F 7/02* (2006.01)
*F24F 13/32* (2006.01)

(52) U.S. Cl.
CPC ..... *F24F 7/025* (2013.01); *F24F 13/32* (2013.01)

(58) Field of Classification Search
CPC ... F24F 7/02; F24F 7/025; F24F 13/32; B01D 46/0004
USPC ..... 454/367, 368
See application file for complete search history.

(56) References Cited

U.S. PATENT DOCUMENTS

| | | | | |
|---|---|---|---|---|
| 5,735,086 | A * | 4/1998 | Fordahl | E04D 13/03 454/195 |
| 5,870,868 | A * | 2/1999 | Kita | E04C 2/384 312/140 |
| 6,289,555 | B1 * | 9/2001 | Nguyen | F24F 7/025 16/235 |
| 6,716,099 | B2 * | 4/2004 | Pfleiderer | F24F 7/02 454/41 |
| 8,535,128 | B2 | 9/2013 | Chwala | |
| 8,650,833 | B1 * | 2/2014 | Polston | F24F 13/084 454/250 |
| 9,303,887 | B1 * | 4/2016 | Chwala | F24F 13/32 |
| 2006/0016339 | A1 * | 1/2006 | Mirza | B01D 46/0004 96/108 |
| 2008/0113611 | A1 * | 5/2008 | Chwala | F24F 7/025 454/341 |

* cited by examiner

*Primary Examiner* — Steven S Anderson, II
(74) *Attorney, Agent, or Firm* — Warner J. Delaune; Baker Donelson, et al.

(57) ABSTRACT

In a rooftop ventilator having a base housing, a lid operatively attached to the base housing, wherein the lid has a plurality of lid sides extending downwardly from a lid surface, and a ventilation fan positioned above the lid surface, a lid reinforcement device is provided, comprising corner reinforcing members attached to the corners of the lid. Each corner reinforcing member comprises a pair of side members flush with the lid sides, and one or more support fingers for receiving and supporting the lid sides. A corner cap is attached to the side members and overlaps the lid surface to retain the lid sides within the support fingers. The corner caps can also include cylindrical sleeves for engagement with a pair of hinge shafts extending from shaft support brackets attached to the base housing.

11 Claims, 5 Drawing Sheets

ROOF VENTILATOR REINFORCEMENT AND HINGE SYSTEM

CROSS-REFERENCE TO RELATED APPLICATIONS

This nonprovisional application claims the benefit of priority to U.S. provisional application Ser. No. 62/319,516, filed on Apr. 7, 2016.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

1. Field of the Invention

The invention relates generally to devices and methods used in rooftop ventilator systems, and more particularly to reinforcements for hinged lids which support the ventilator.

2. Description of Related Art

In commercial ventilation systems for buildings, exhaust fans are mounted over vents in a roof. For example, a fan-assisted vent at a restaurant permits an exhaust to be withdrawn from the kitchen. Through this vent, grease and other cooking residue are allowed to leave the building. After a period of use, the vent and the fan become contaminated with grease. Other cooking residue also becomes adhered to the fan blades and other surfaces. Such residue can be flammable and presents a fire hazard, and can also attract undesirable microbes and illness-causing bacteria, requiring occasional cleaning.

In most of these systems, a rectangular base housing rises above the roof vent, and the open base housing is covered by a rectangular lid. The lid is sometimes referred to as a shoebox lid, because it is similar in construction to a cardboard shoebox, but formed from sheet metal. A large hole exists in the lid, and the fan is securely mounted to the lid. The National Fire Protection Association (NFPA) 96 "Standard for Ventilation Control and Fire Protection of Commercial Cooking Operations", federal, county, city, and local codes require fans and duct work to be inspected, cleaned if necessary, and maintained. For maintenance purposes, the lid is typically hinged to the base housing, allowing a worker to raise the lid and rotate the lid and fan assembly away from the base housing for proper access.

The problem for many workers is that the lid can be difficult to grasp, requiring the worker to lift the edges of the lid with fingers, and then rotate the heavy fan and lid assembly back into a fixed open position. A similar difficulty exists when closing the lid when the work is finished, because the worker must grip the side of the lid and gently allow it to close, being careful not to get his fingers pinched between the lid and the base housing. Furthermore, the lid itself can be somewhat flexible, and it may become deformed or otherwise misshapen over the course of time and extensive use, resulting in an imprecise fit between the lid and the base housing.

Therefore, there is a need for a device which can be attached to the lid that reinforces the lid, allowing easier and safer opening and closing of the lid when maintenance is required. The device should be simple to install and use, and it should not require any irreversible modifications, such as drilling for fasteners, to the lid itself.

SUMMARY OF THE INVENTION

In a rooftop ventilator having a base housing, a lid operatively attached to the base housing, wherein the lid has a plurality of lid sides extending downwardly from a lid surface, and a ventilation fan positioned above the lid surface, a lid reinforcement device is provided, comprising an L-shaped corner reinforcing member attached to a corner of the lid, the corner reinforcing member comprising: (i) a first side member flush with one of the lid sides, and a second side member flush with another lid side, wherein each of the first side member and the second side member includes a horizontal flange substantially flush with the lid surface; and (ii) one or more support fingers extending from each of the first side member and the second side member, wherein the support fingers are adapted to receive and support the lid sides. A corner cap is attached to the horizontal flanges of the first and second side members, wherein the corner cap overlaps the lid surface to retain the lid sides within the support fingers. The corner cap is preferably secured to the corner reinforcing member by threaded fasteners through the horizontal flanges of the first and second side members.

In the preferred embodiment, the lid has four corners and four lid sides, and wherein the lid reinforcement device comprises four corner reinforcing members and four corner caps; each of the corner reinforcing members is attached to a respective corner of the lid; and each of the corner caps is attached to a respective corner reinforcing member.

In a further embodiment, the first side member and second side member are joined by a common bend joint, or the corner reinforcing member is constructed from a single metal sheet.

In a more preferred embodiment, the first side member of one of the corner reinforcing members overlaps the second side member of another corner reinforcing member, and the overlapping side members are fixed relative to one another by a set screw.

Preferably, each of the horizontal flanges includes a U-shaped overhang member for imparting rigidity to the horizontal flanges.

In another embodiment, the corner cap includes a pair of side flanges, and at least two corner caps are attached to adjacent corners of the lid, wherein each corner cap includes a cylindrical sleeve adapted to receive a hinge shaft, and wherein the cylindrical sleeves of the corner caps are axially aligned. In this embodiment, the base housing includes a pair of shaft support brackets, wherein each shaft support bracket includes a hinge shaft extending through a shaft support hole, and wherein each of the hinge shafts resides within the respective cylindrical sleeves on the corner caps. Optionally, the shaft support bracket includes a plurality of shaft support holes.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements.

DETAILED DESCRIPTION OF THE INVENTION

The present invention is a non-intrusive lid reinforcement assembly which serves as a strengthening system for use by workers to open and close the lid and fan assembly on rooftop ventilation systems. In such an installation, the reinforcement assembly requires no holes, drilling, tapping or penetration into the lid, and it allows a solid framework for a shoebox-style lid. It can also be removed or reinstalled quickly if the need arises.

Figure 1:
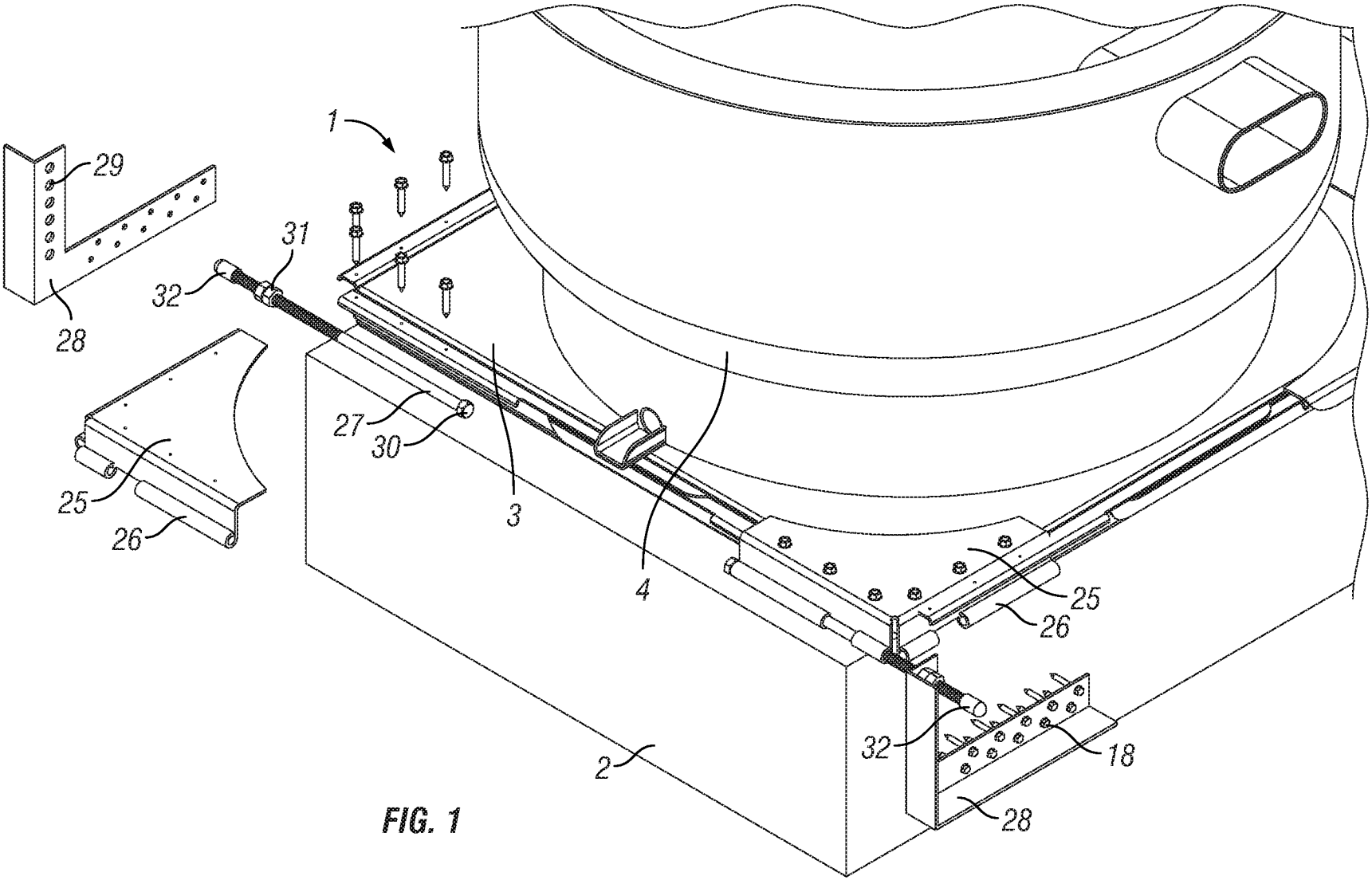
FIG. 1 illustrates a preferred embodiment of a lid reinforcement and hinge system of the present invention showing the corner reinforcing members and hinge members in an assembled orientation.
Figure 2:
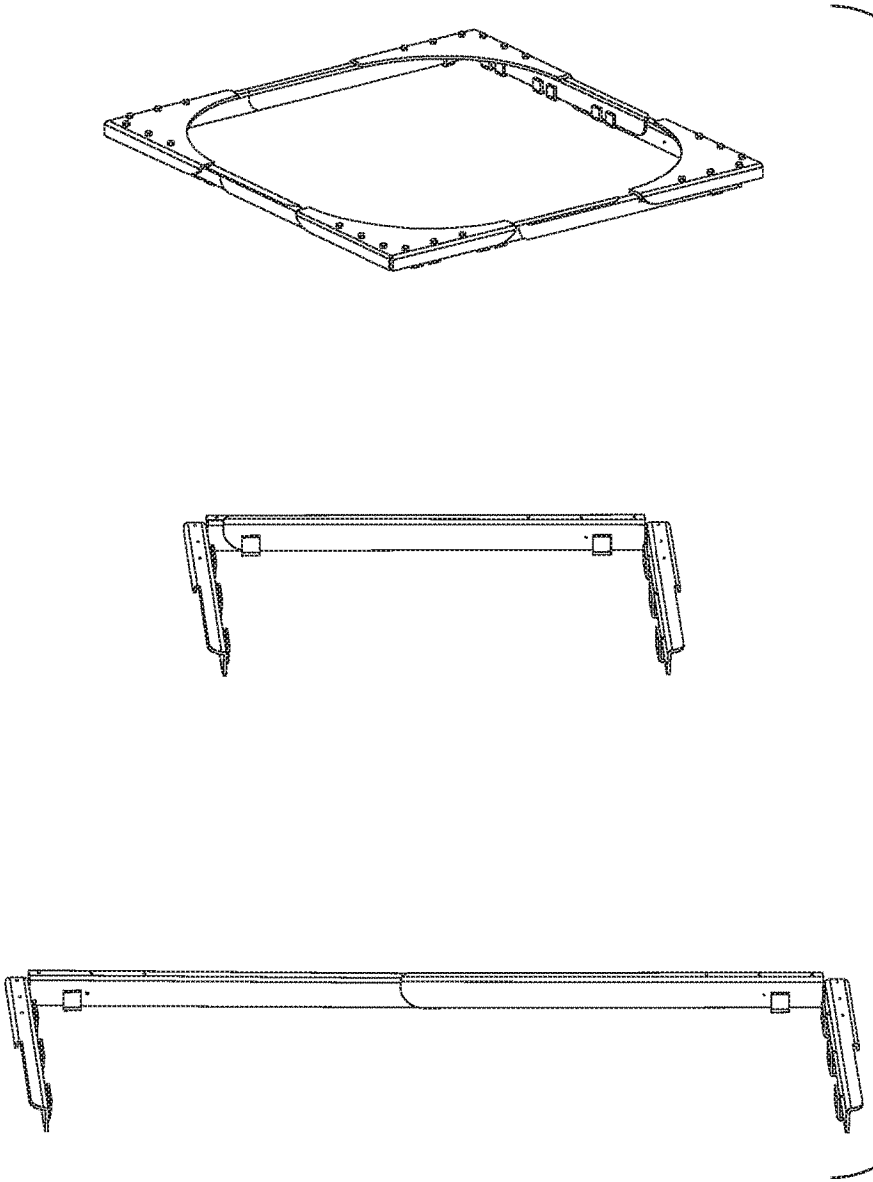
FIG. 2 illustrates a perspective view of the reinforcing members of FIG. 1 prior to installation on the lid.
Figure 2:
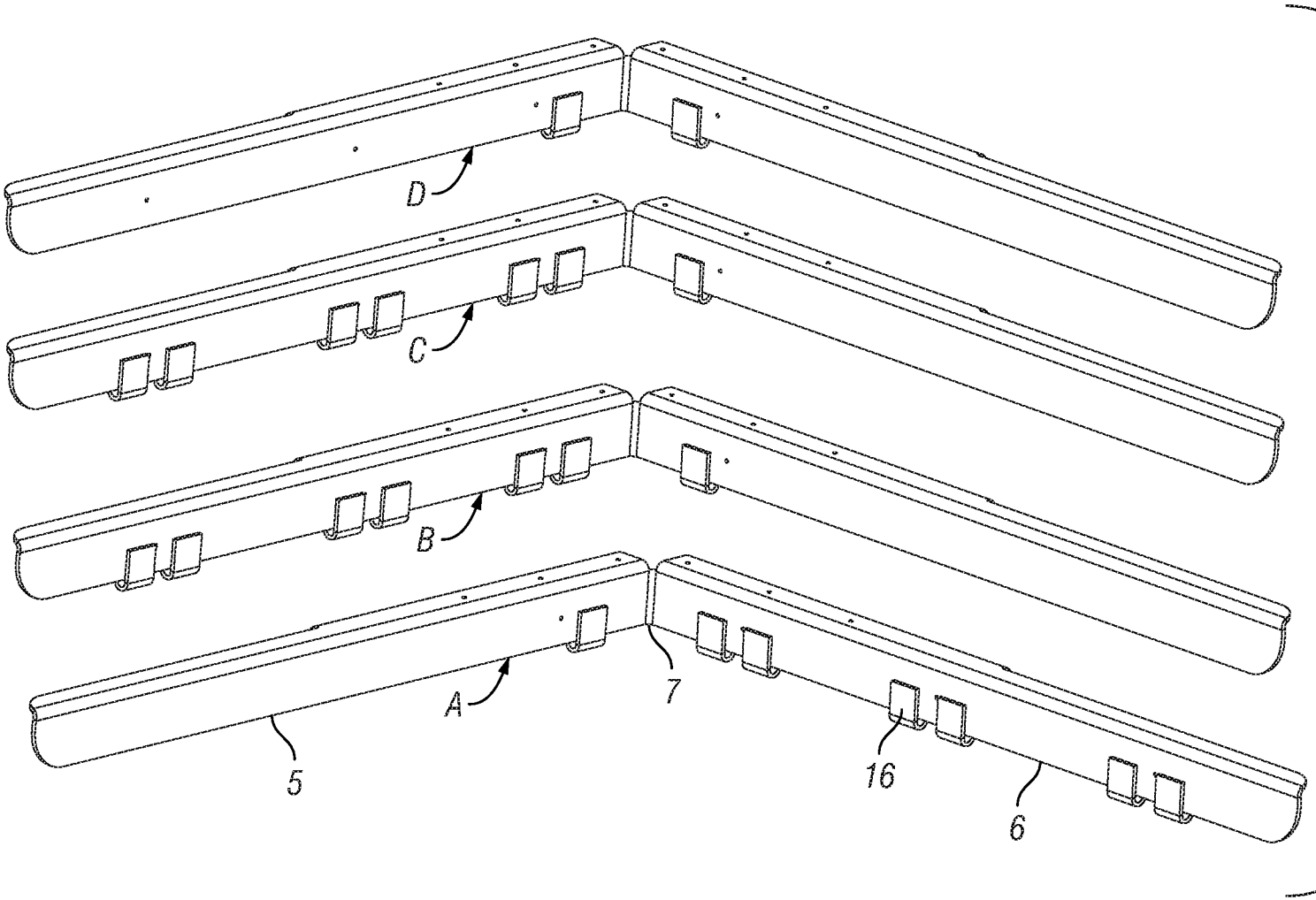
Figure 3:
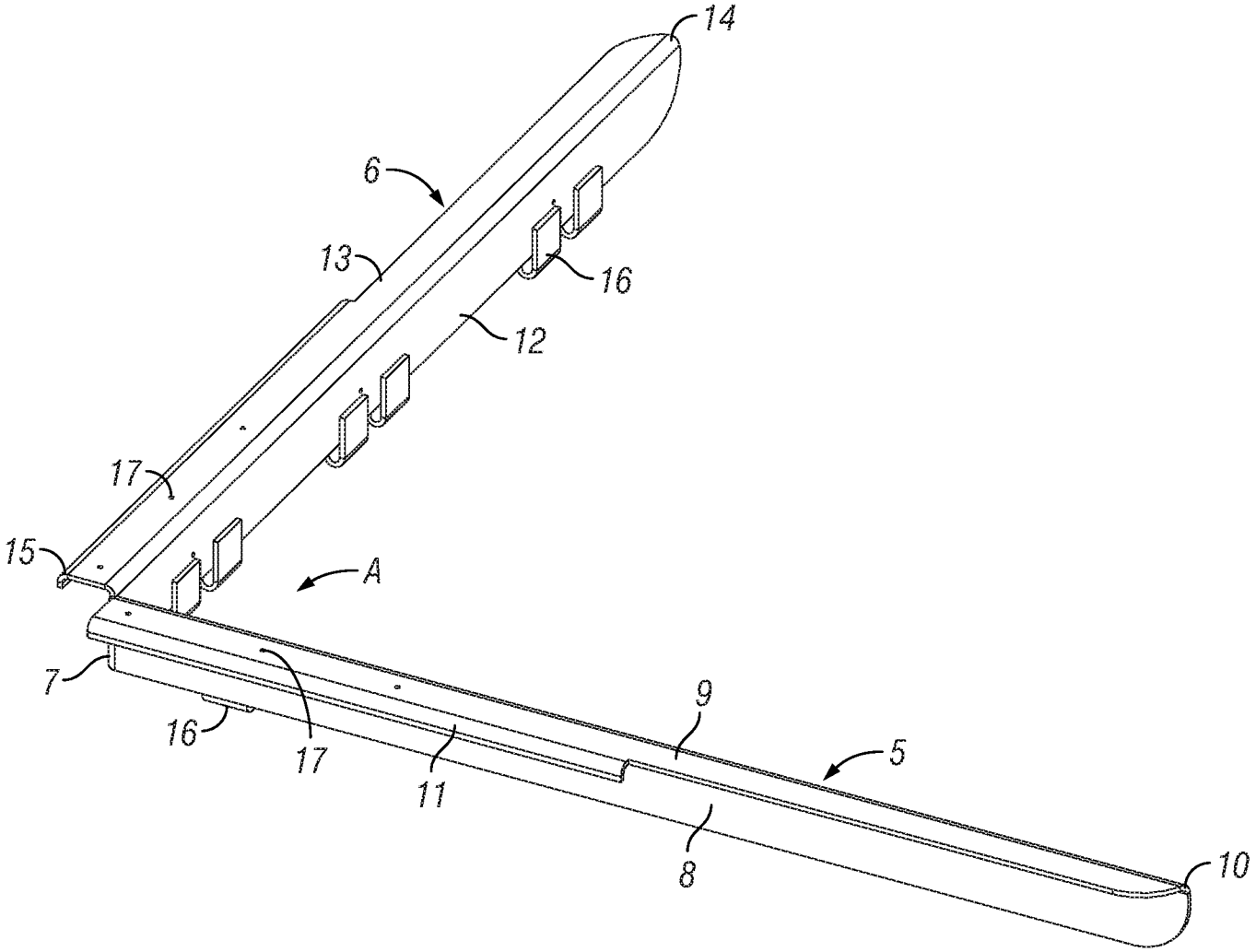
FIG. 3 illustrates another perspective view of a single corner reinforcing member of FIG. 1 to show further detail.
Figure 4:
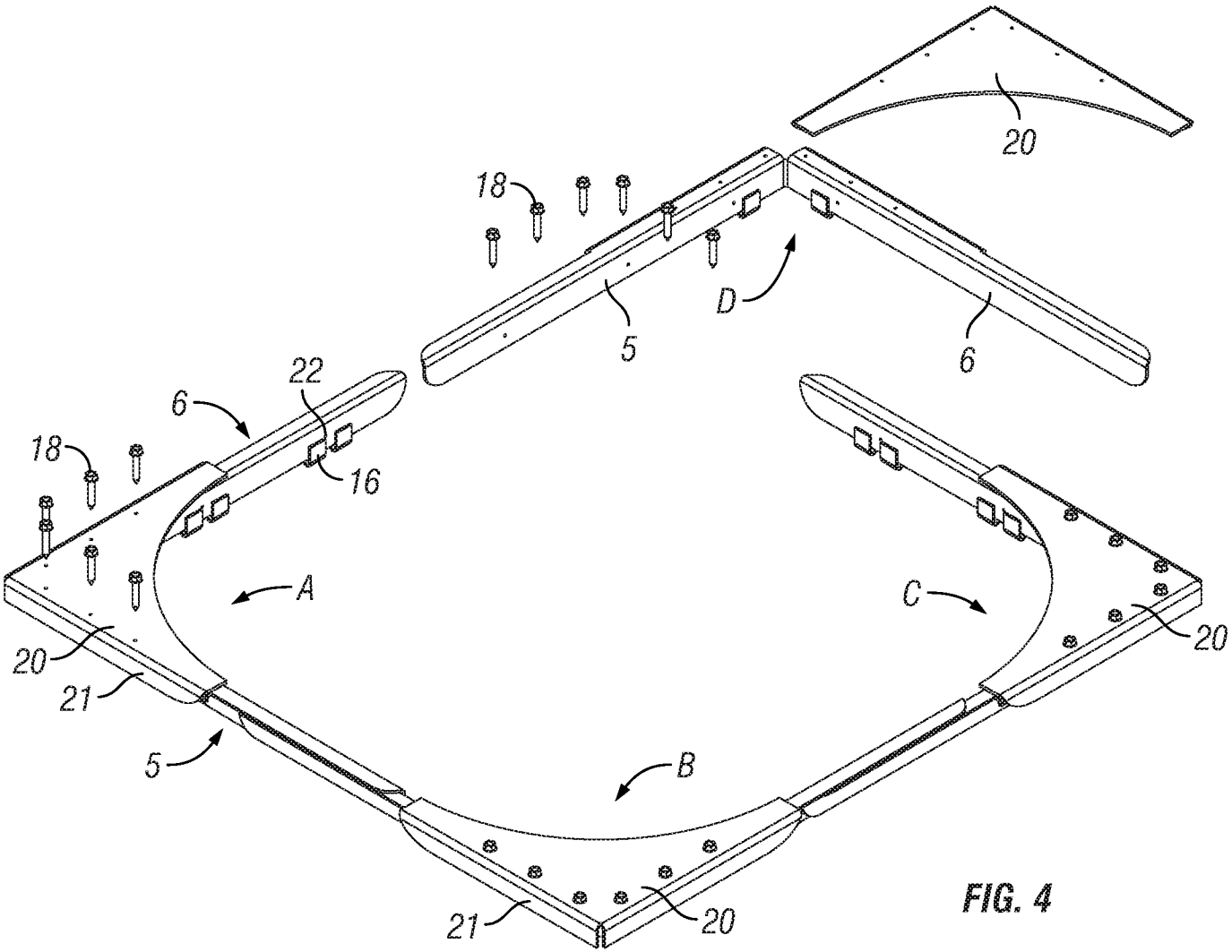
FIG. 4 illustrates another perspective view of the corner reinforcing members and corner caps of FIG. 1 in a partially assembled state, but omitting the lid for clarity.

As shown in FIG. 1, a common roof ventilation system is shown to comprise a fan base housing 2, a showbox-style lid 3 having a top lid surface, and a ventilation fan 4. Referring also to FIGS. 2-4, the reinforcement assembly 1 generally comprises four L-shaped corner reinforcing members A, B, C, D for each corner of the lid 3, wherein each corner reinforcing member A, B, C, D is alignable with corresponding components of adjacent corner reinforcing members as will be described below.

For example, as shown in FIG. 3, a single corner reinforcing member A is shown of unitary construction and includes a first side member 5 and a second side member 6 which are affixed to one another by a common bend joint 7. By unitary construction, it should be understood that each corner reinforcing member A, B, C, D can start from a single piece of flat sheet metal, and then bent to form all of the flanges and other features described below. A similar result can be achieved using non-metal materials and injection molding and similar processes know in the art.

First side member 5 includes an elongated vertical flange 8 and an elongated horizontal flange 9 which are formed along a common bend joint 10. The horizontal flange 9 includes an overhang member 11 extending from the bend joint 7 to about half the length of first side member 5, which results in a U-shaped cross section to increase the structural rigidity of the horizontal flange 9.

Similarly, second side member 6 includes an elongated vertical flange 12 and an elongated horizontal flange 13 which are formed along a common bend joint 14. The horizontal flange 13 includes an overhang member 15 extending from the bend joint 7 to about half the length of second side member 6, which results in a U-shaped cross section to increase the structural rigidity of the horizontal flange 13.

As can be seen in FIG. 1, the first and second side members 5, 6 are flush with a lid sides of lid 3 when installed. Also, the horizontal flanges 9, 13 are substantially flush with the top surface of lid 3 when installed, so as to enable installation of the corner caps 20, 25 as explained below.

With continuing reference to FIG. 3, second side member 6 further includes a plurality of J-shaped support fingers 16 which grip the downwardly extending sides (or "curbs") of the lid 3. In other words, in an assembled configuration, the side of the lid 3 is received and supported by within the support fingers 16. Similarly, first side member 5 includes at least one support finger 16 for the identical purpose of gripping an adjacent downwardly extending side or curb of the lid 3. Each of the horizontal flanges 9, 13 includes a plurality of holes 17 to receive self-tapping screws 18 (best shown in FIG. 4) which hold a corner cap 20 with a pair of side flanges 21 to cover the exposed corner ends of first and second side members 5, 6, and to effectively retain the corner of lid 3 between the corner cap 20 and the lower corner reinforcing member A. In other words, in a fully installed state, with all corner reinforcing members A, B, C, D in place, the lid 3 becomes non-intrusively "sandwiched" firmly between the corner caps 20 and the corner reinforcing members A, B, C, D, but without having to drill holes into or otherwise deform the lid 3.

Based on the above description, and with further reference to FIG. 4, it can be seen that a set of corner reinforcing members A, B, C, D can be used to reinforce a range of sizes and shapes for the lid 3. For example, as the corner reinforcing members are placed into position, the first side 5 of corner reinforcing member D can be "nested" in a matable fashion underneath second side 6 of corner reinforcing member A, as can also be seen with respect to members D and C, C and B, and B and A. For smaller lids 3 with shorter dimensions, there would be substantial overlap between such components. For larger lids 3, there would be less overlap, but still some amount of mating contact between components to still establish a strong and rigid framework of reinforcing members. In any case, once the corner reinforcing members A, B, C, D are installed, a set screw 22 can be installed through these nested and mating flanges to further lock and reinforce their relative positions on the lid 3.

The aforementioned lid reinforcing system can be used with all four identical and interchangeable corner caps 20 to achieve the singular purpose of reinforcing the lid 3. However, as shown in FIG. 1, modified corner caps 25 can also be employed in connection with an improved hinging system. Each modified corner cap 25 includes at least one side having one or more rolled leaves (or cylindrical sleeves) 26 which serves as a cylindrical holder for a hinge shaft 27. Preferably, each corner cap 25 includes two sets of cylindrical sleeves 26, e.g. on each perpendicular side, so that the corner caps 25 can be of "universal" design and can be used on either corner of the lid 3. When corner cap 25 is installed as described above for the two corners of lid 3 near the hinge, the hinge shafts 27 are supported by the axially aligned cylindrical sleeves 26 and their respective shaft support bracket 28. A shaft support bracket 28 is installed on both of the opposing sides of the fan base housing 2 using self-tapping screws 18. For adjustment purposes, the shaft support bracket 28 includes a plurality of vertically aligned shaft support holes 29. In a preferred embodiment, the shaft 27 is a threaded bolt having a bolt head 30, and the shaft 27 is secured by a shaft nut 31, which can also be a double-nut arrangement to maintain the nut 31 in place. To protect the user, a plastic safety cap 32 may also be installed on the exposed threaded end of shaft 27.

The corner members A, B, C, D and corner caps 20, 25 are generally produced from a 16 ga cold rolled low carbon steel, although other suitable materials may be used, such as aluminum or plastic. As made of general metal material, the product will be either plasma cut, water jet cut, laser cut, punched or stamped from sheets or rolls of metal although new and better forms of parting the metal may be used at a further date to increase productivity or reduce cost, etc. When made of material other then metal, forming processes common in manufacturing and production will be employed from injection molding, roto-molding, heat formed and or any other production grade forming of the material into the same form and serving the same function as the metal design. Once flat blanks are produced, assuming metal but not limited to metal, the flats blanks will be formed using a press or die and generally powder-coated. If desired per customer request or by design needs, final surfacing may be improved for the product's abilities to combat environmental conditions once in service, or to meet an as of yet undefined characteristic either generally aesthetically pleasing of necessary for the preservation of function in an unforeseen environment.

All references cited in this specification are herein incorporated by reference as though each reference was specifically and individually indicated to be incorporated by reference. The citation of any reference is for its disclosure prior to the filing date and should not be construed as an admission that the present invention is not entitled to antedate such reference by virtue of prior invention.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

We claim:

1. In a rooftop ventilator having a base housing, a lid operatively attached to the base housing, wherein the lid has a plurality of lid sides extending downwardly from a lid surface, and a ventilation fan positioned above the lid surface, a lid reinforcement device, comprising:

(a) an L-shaped corner reinforcing member attached to a corner of the lid, the corner reinforcing member comprising:

(i) a first side member flush with a first lid side, and a second side member flush with a second lid side which is perpendicular to the first lid side, wherein each of the first side member and the second side member includes a horizontal flange substantially flush with the lid surface; and (ii) one or more support fingers extending from each of the first side member and the second side member, wherein the one or more support fingers are adapted to receive and support the lid sides; and (b) a corner cap attached to the horizontal flanges of the first and second side members, wherein the corner cap overlaps the lid surface to retain the first and second lid sides within the one or more support fingers.

2. The device of claim 1, wherein the lid has four corners and four lid sides, and wherein:

(a) the lid reinforcement device comprises four corner reinforcing members and four corner caps;

(b) each of the corner reinforcing members is attached to a respective corner of the lid; and (c) each of the corner caps is attached to a respective corner reinforcing member.

3. The device of claim 1, wherein the first side member and second side member are joined by a common bend joint.

4. The device of claim 1, wherein the corner reinforcing member is constructed from a single metal sheet.

5. The device of claim 1, wherein the first side member of one of the corner reinforcing members overlaps the second side member of another corner reinforcing member, and wherein the overlapping side members are fixed relative to one another by a set screw.

6. The device of claim 1, wherein each of the horizontal flanges includes a U-shaped overhang member.

7. The device of claim 1, wherein the corner cap is secured to the corner reinforcing member by threaded fasteners through the horizontal flanges of the first and second side members.

8. The device of claim 1, wherein the corner cap includes a pair of side flanges.

9. The device of claim 1, wherein at least two corner caps are attached to adjacent corners of the lid, wherein each corner cap includes a cylindrical sleeve adapted to receive a hinge shaft, and wherein the cylindrical sleeves of the corner caps are axially aligned.

10. The device of claim 9, wherein the base housing includes a pair of shaft support brackets, wherein each shaft support bracket includes the hinge shaft extending through a shaft support hole, and wherein each of the hinge shafts resides within the respective cylindrical sleeves on the corner caps.

11. The device of claim 10, wherein each shaft support bracket includes a plurality of shaft support holes.

* * * * *